US006776511B1

(12) United States Patent
Lindsay

(10) Patent No.: US 6,776,511 B1
(45) Date of Patent: Aug. 17, 2004

(54) STRUCTURES FOR LIGHTING FIXTURES

(76) Inventor: Lance Trimble Lindsay, 6219 Porterdale Rd., Malibu, CA (US) 90265

( * ) Notice: Subject to any disclaimer, the term of this patent is extended or adjusted under 35 U.S.C. 154(b) by 0 days.

(21) Appl. No.: 09/654,977

(22) Filed: Sep. 5, 2000

(51) Int. Cl.[7] ..... F21V 15/00

(52) U.S. Cl. ..... 362/377; 362/378; 362/122; 362/123; 362/267; 362/96; 362/351; 362/353; 362/441; 362/443

(58) Field of Search ..... 362/377, 378, 362/122, 123, 351, 267, 96, 437, 441, 442, 443, 448, 368, 353, 414, 431; D26/67, 68, 69, 70, 71, 73, 4

(56) References Cited

U.S. PATENT DOCUMENTS

| | | | | | |
|---|---|---|---|---|---|
| 721,435 | A | * | 2/1903 | Fielding | 362/311 |
| 2,432,632 | A | * | 12/1947 | Siebel | 362/567 |
| 3,050,619 | A | * | 8/1962 | Abramson | 362/255 |
| 4,547,839 | A | | 10/1985 | Ripley | |
| 4,549,252 | A | | 10/1985 | Ripley | |
| 4,564,890 | A | * | 1/1986 | Poyer | 362/216 |
| 4,679,126 | A | | 7/1987 | Van Sickler | |
| 4,763,233 | A | * | 8/1988 | Poyer | 362/216 |
| 4,789,572 | A | * | 12/1988 | Weaver | 428/26 |
| 5,122,942 | A | * | 6/1992 | Lee | 362/353 |
| 5,414,605 | A | | 5/1995 | Lin | |
| 5,641,223 | A | * | 6/1997 | Rustebakke | 362/122 |
| 5,709,457 | A | | 1/1998 | Hara | |
| D392,763 | S | * | 3/1998 | Denison et al. | D26/68 |
| 5,722,771 | A | | 3/1998 | Wang | |
| 5,749,648 | A | | 5/1998 | Lin | |
| 5,848,839 | A | | 12/1998 | Savage, Jr. | |
| 5,918,967 | A | | 7/1999 | Land | |
| 5,975,721 | A | | 11/1999 | Wu | |
| 5,993,024 | A | | 11/1999 | Tseng | |
| 6,043,594 | A | | 3/2000 | Huang | |
| 6,048,072 | A | | 4/2000 | Yen | |
| 6,053,620 | A | | 4/2000 | Won | |
| 6,062,705 | A | | 5/2000 | Zimmer et al. | |
| 6,070,997 | A | | 6/2000 | Duke et al. | |
| 6,206,546 | B1 | * | 3/2001 | Krogman | 362/267 |

* cited by examiner

*Primary Examiner*—Stephen Husar
*Assistant Examiner*—Bertrand Zeade
(74) *Attorney, Agent, or Firm*—Joesph A. Yanny; Michael A. DiNardo; Stacie J. Sundquist

(57) ABSTRACT

There are three different embodiments of lamp assemblies according to this invention that can be exposed to forms of moisture and still be protected against a potentiality of short-circuiting. The first embodiment has the lamp shade oriented below a horizontal plane. The lamp shade is secured to a base with an o-ring mounted there between, and this secured connection-is covered by a base cap. The base cap and o-ring prevent water from entering the lamp shade at the connection with the base, and the orientation of the entire assembly below the horizontal plane prevents water from entering the open end of the lamp shade. The second embodiment has the lamp shade resting in a base cap and the socket and base of the electrical components are arranged in the fixture such that the top of the socket and base rise above the top edge of the base cap. The arrangement of the socket and base above the top edge of the base cap allows for accumulated precipitation to run-over the edge before reaching the level of the base or socket. The third embodiment has a lamp shade with a tube inside which is closed on the top end and open on the bottom end. The lamp shade and tube rest in the base cap and contain the base and socket. The closed tube prevents water from reaching the electrical components. The base cap incorporates a drainage hole in the bottom allowing accumulated water to drain out of the bottom.

5 Claims, 7 Drawing Sheets

STRUCTURES FOR LIGHTING FIXTURES

BACKGROUND OF THE INVENTION

1. Field of the Invention

This invention relates to a lamp assembly in which the electrical components are protected from rain and other forms of precipitation or other forms of moisture by novel mechanical arrangements.

2. Description of the Related Art

Conventional lamp assemblies that might be potentially exposed to some form of precipitation typically are sheltered from direct rain, as when hanging beneath the eave of a roof. Other lamp assemblies are exposed to direct precipitation. The electrical components of such lamps, whether sheltered or exposed directly to weathering elements, are generally sealed with tight-fitting gaskets, snug set-screws, and/or complicated and difficult-to-remove shade and deflection assemblies preventing water from reaching the electrical components.

Drawbacks of such prior art lamp assemblies include: (1) difficulty in access to and changing of the light bulb or other component of the electrical system or shade; (2) difficulty in access to and changing of the gasket, set-screws and/or deflection assemblies; (3) the gasket, set-screws and/or shade and deflection assemblies may fail and allow precipitation to get to the electrical components, causing a short circuit; and (4) the intricate mechanisms used to protect the prior art lamps may be very expensive to replace.

BRIEF SUMMARY OF THE INVENTION

The main object of this invention is to provide a lamp assembly that is protected from precipitation and thereby short-circuiting.

It is another object of this invention to provide the above protection from precipitation and short circuiting while still providing ease of access to the electrical components of the lighting fixture.

It is a further object of this invention to provide a lamp assembly in which the protective assemblies will not fail and allow precipitation to get to the electrical components of the lighting fixture.

It is still a further object of this invention to provide a lamp assembly in which the assemblies used to protect the electrical components are inexpensive to replace.

According to this invention, there are three different embodiments of the lamp assemblies that are capable of being exposed to precipitation and other forms of moisture (i.e. rain, sprinkler systems, etc.) and still be protected against a potentiality of short-circuiting. Each of these lamp assemblies are ornamental in nature while incorporating the utilitarian features described herein.

According to the present invention, the first of these embodiments has the appearance of an open bloom flower where the petals of the bloom form the lamp shade. This first lamp assembly is oriented below a horizontal plane such that the opening of the bloom is not exposed to open sky to allow falling precipitation or moisture to enter the shade directly. The electrical components of the lamp are contained inside and recessed within the opening of the shade. The electrical components consist of a socket, a base, and an electrical supply means. The lamp shade is secured to the base using a securing means with an o-ring and this secured connection is covered by a base cap. The base cap and o-ring prevent water from entering the lamp shade at the connection with the base, and the orientation of the entire assembly below the horizontal plane prevents water from entering the open end of the lamp shade.

In the second embodiment, the lamp assembly has the appearance of a closed flower bud on a nearly vertical stem where the lamp shade is formed from the petals of the closed flower bud. The electrical components of the lamp are contained inside the lamp shade. The electrical components consist of a socket, a base, and an electrical supply means. The lamp shade rests in a base cap and is easily removed from the same for access to the electrical components. In one construction of this embodiment, the socket and base of the electrical components are arranged in the fixture such that the top of both the socket and the base rise above the top edge of the base cap. An alternate construction has the socket and base recessed within the distal edge of the base cap. The arrangement of the socket and base rising above the top edge of the base cap allows for accumulated precipitation to run-over the edge of the base cap before reaching the level of the base or socket.

In the third embodiment, the lamp assembly has the appearance of a partially open flower bud on a nearly vertical stem where the lamp shade is formed from the petals of the flower bud. The lamp shade also includes a tube inside which is closed on the top end and open on the bottom end. The electrical components of the lamp are contained inside the tube and, in turn, inside the lamp shade. The electrical components consist of a socket, a base, and an electrical supply means. The lamp shade rests in a base cap and is easily removed from the same for access to the electrical components. In one construction of this embodiment, the base cap incorporates a drainage hole in the bottom to allow accumulated water to drain out of the bottom of the base cap. In an alternate embodiment, the base cap does not have a drainage hole and the base and socket extend beyond the distal edge of the base cap.

DETAILED DESCRIPTION OF THE INVENTION

The instant invention is directed to novel designs for lighting fixtures. Primarily, the lighting fixtures of the instant invention are intended for outdoor use wherein the fixtures are exposed to elements of nature, namely, precipitation. In addition, the lighting fixtures of the present invention are useful in gardens, or similar areas, where water, as from sprinkler systems, is present. The lighting fixtures of the present invention are also intended to be used with low voltage electrical systems to lessen the likelihood and resultant damage of a short circuit. However, the inventive features described in the present invention work equally as well for indoor use and with normal and high voltage systems.

The novel designs of the present invention address the shortcomings of prior art outdoor lighting fixtures, namely, providing: (i) a lamp assembly that is protected from precipitation and thereby short circuiting; (ii) protection from precipitation and short circuiting while still providing ease of access to the electrical components of the lighting fixture; (iii) a lamp assembly in which the protective assemblies will not fail and allow precipitation to get to the electrical components of the lighting fixture; and (iv) a lamp assembly in which the assemblies used to protect the electrical components are inexpensive to replace.

Figure 1:
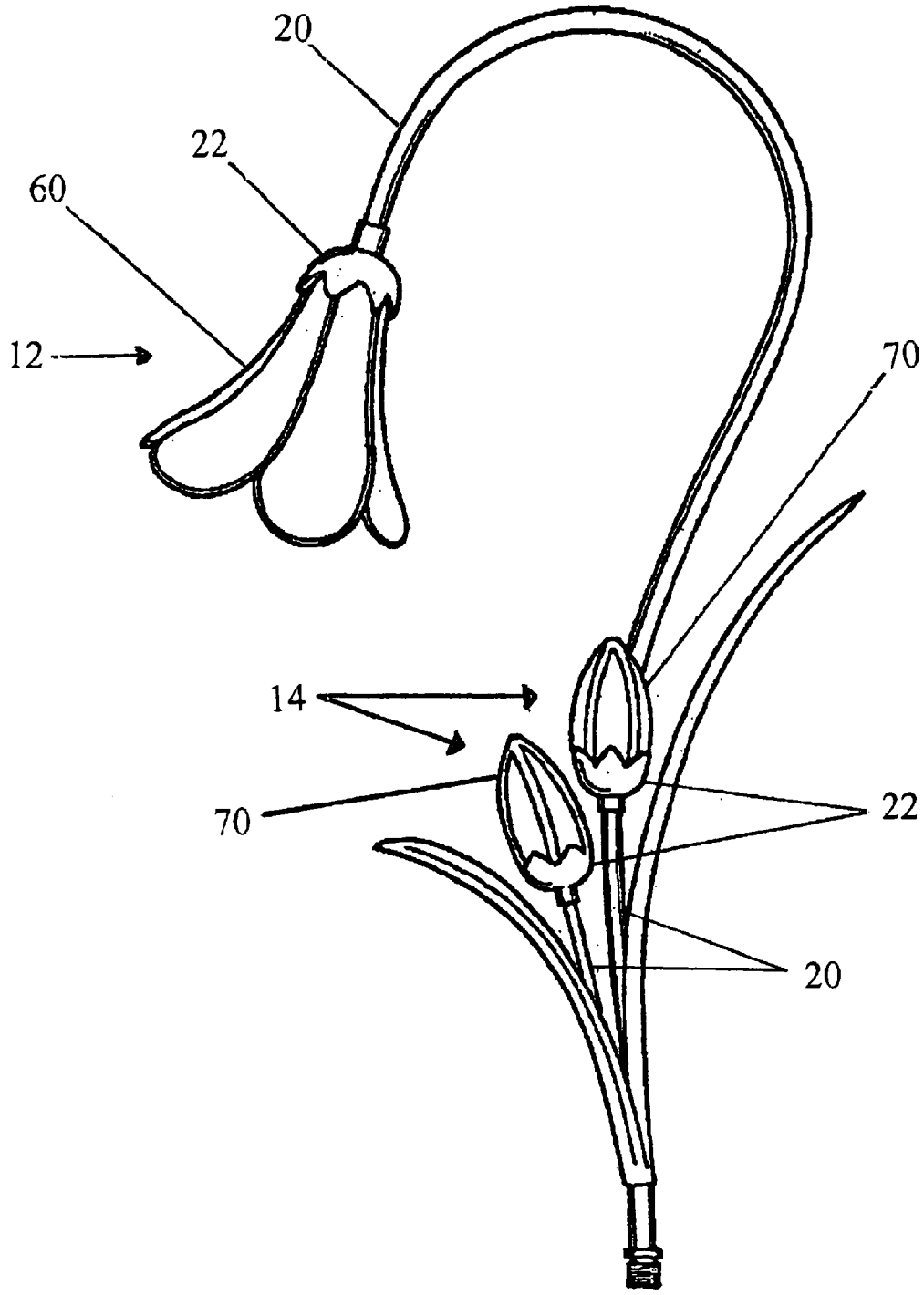
FIG. 1 shows a side view of a complete lamp structure
Figure 4A:
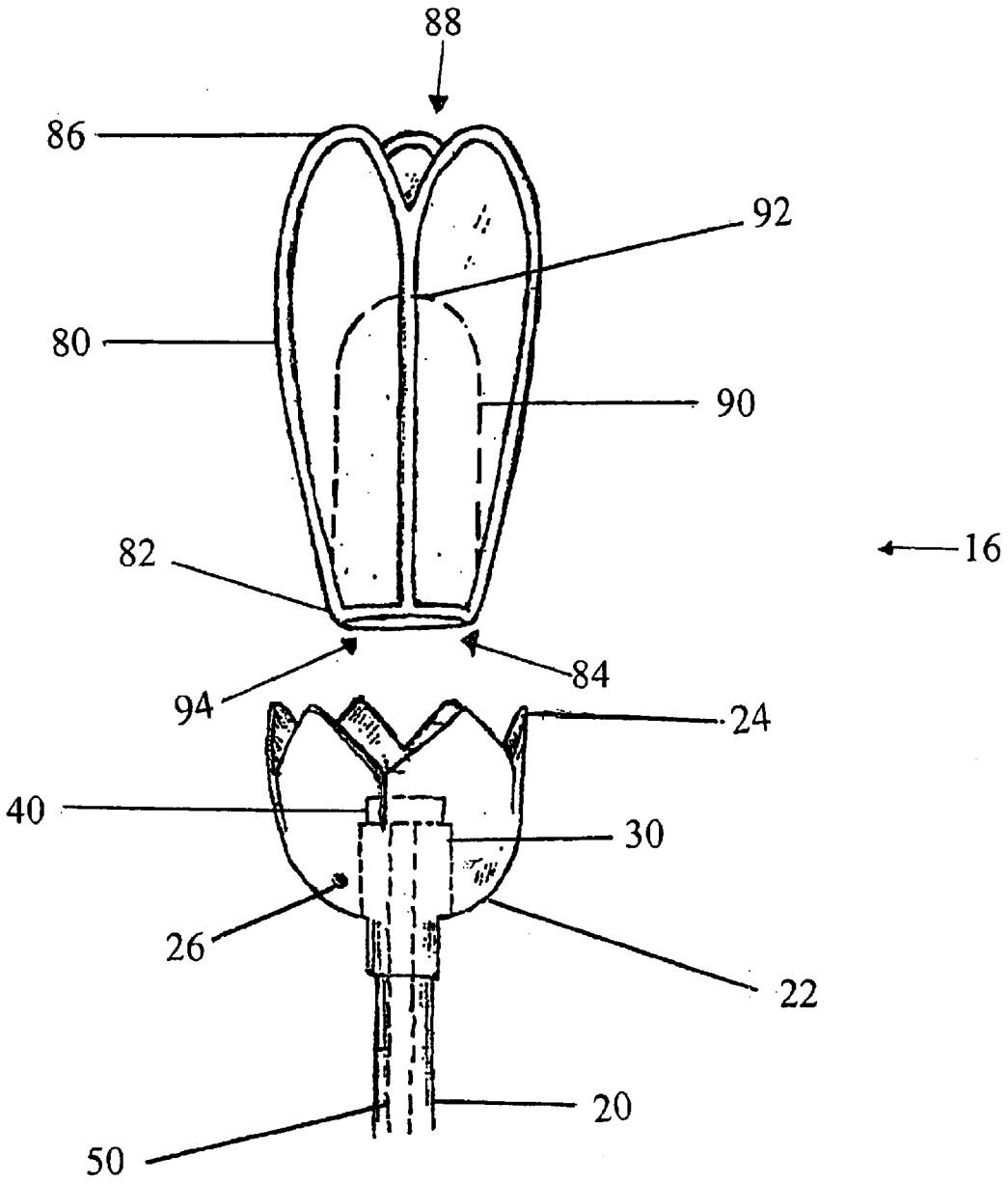
FIG. 4*a* shows a side view of the third preferred embodiment
Figure 4B:
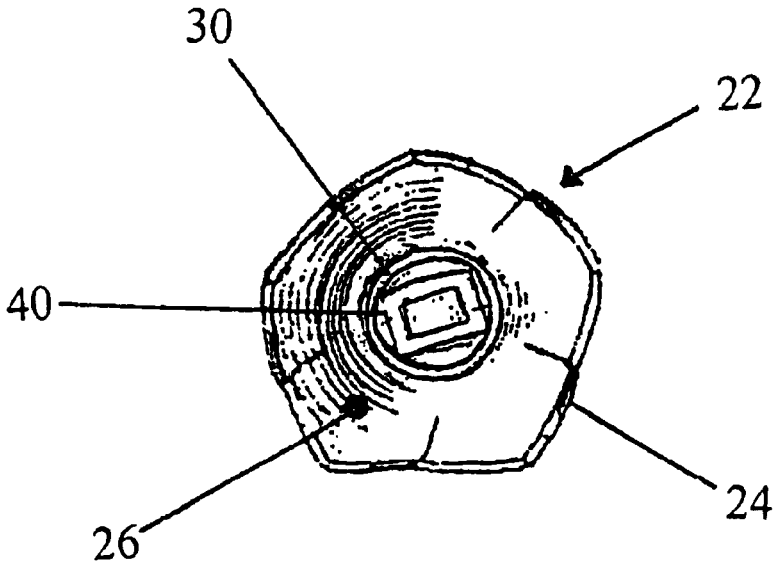
FIG. 4*b* shows a top view of the base cap of the third preferred embodiment
Figure 4C:
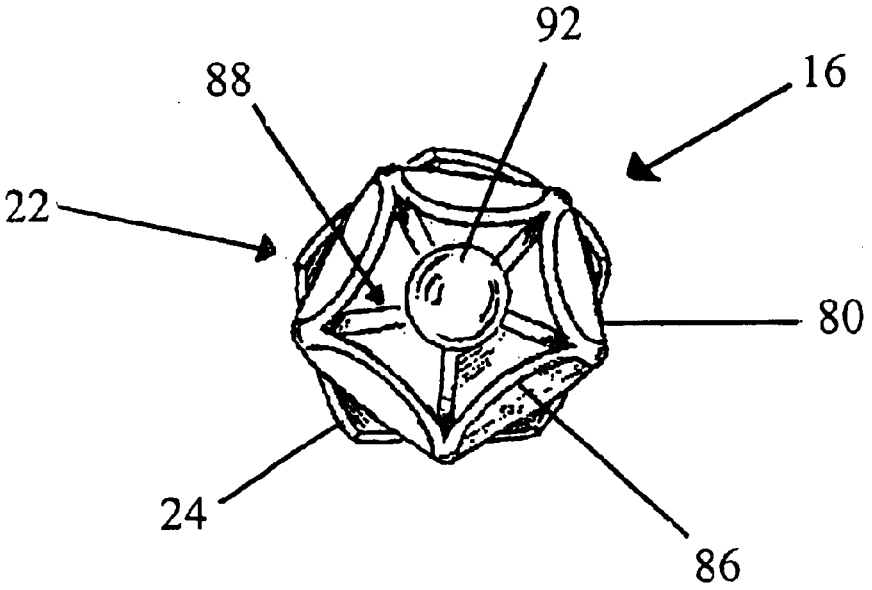
FIG. 4*c* shows a top view of the lighting fixture of the third preferred embodiment

There are three preferred embodiments of the present invention. FIG. 1 shows a complete lamp structure incorporating the lighting fixture (12) of the first preferred embodiment and the lighting fixture (14) of the second preferred embodiment. The lighting fixture (16) of the third preferred embodiment is shown in FIGS. 4*a*, 4*b*, and 4*c* and is capable of substitution with the lighting fixture (14) of the second preferred embodiment.

Figure 2A:
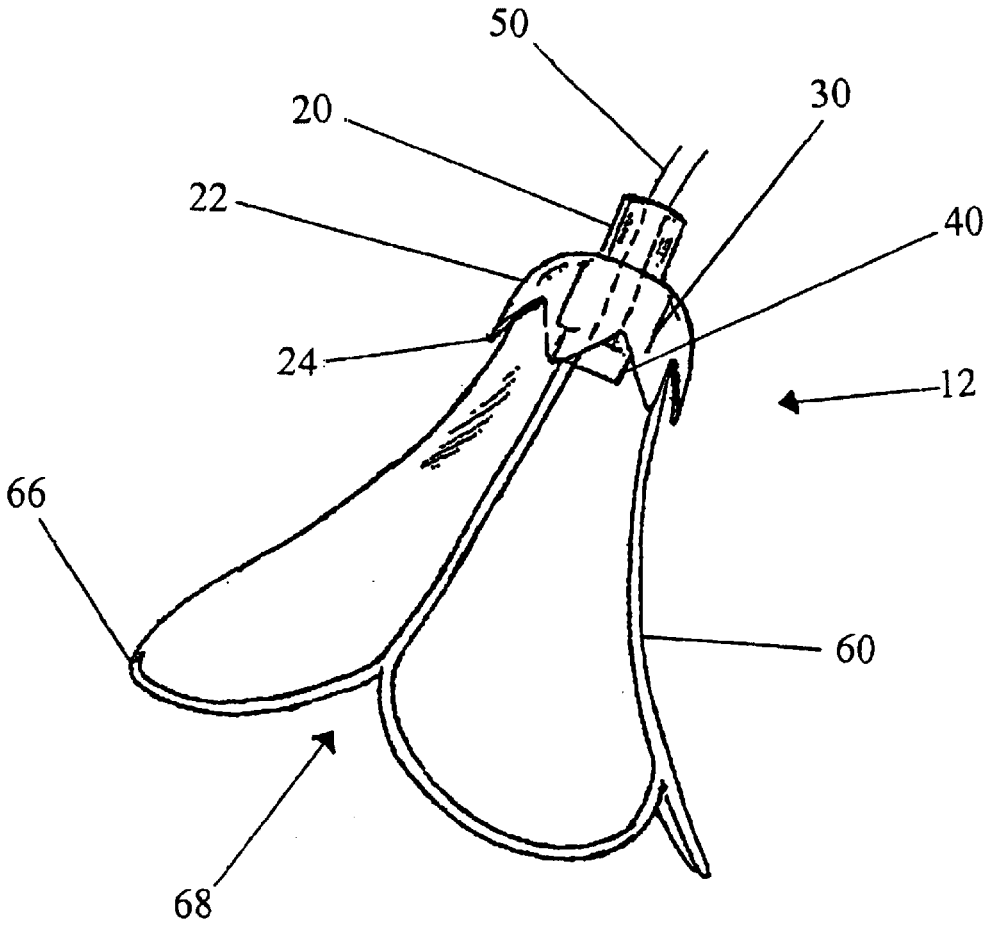
FIG. 2*a* shows an enlarged side view of the first preferred embodiment
Figure 2B:
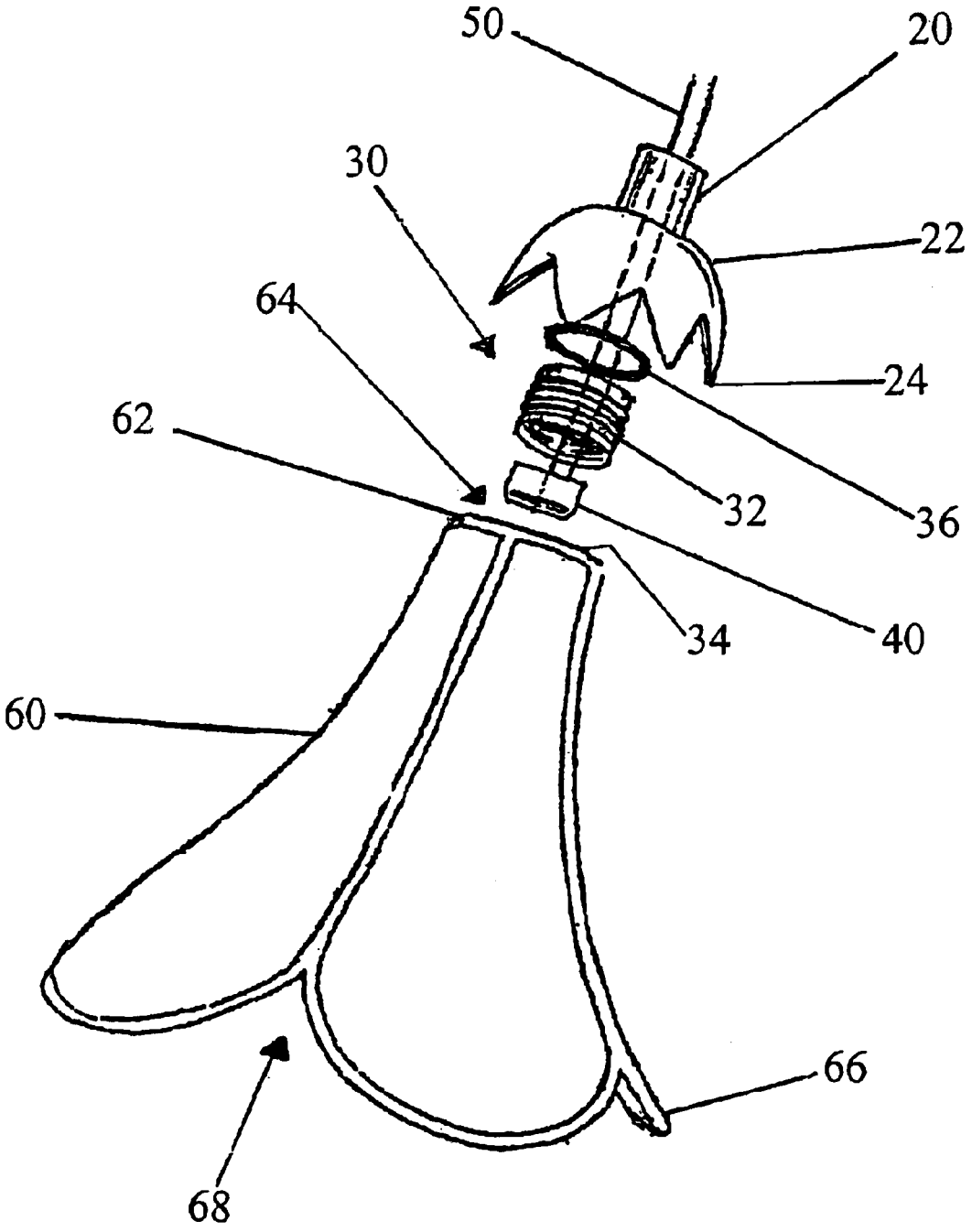
FIG. 2*b* shows an exploded side view of the first preferred embodiment

As shown in FIGS. 2*a* and 2*b*, the first preferred embodiment of the lighting fixture (12) of the present invention has the appearance of an open bloom flower where the petals of the bloom form the lamp shade (60). The lighting fixture (12) comprises a stem (20) which consists of a hollow metal tube. One end of the stem (20) is connected to an electrical source by way of an electrical supply means (50). The electrical supply means (50) will be discussed further below.

The other end of the stem (20) is connected to a base cap (22). The base cap (22) has a distal edge (24) which is distant from the stem (20). A base (30) is connected to the base cap (22) and contained within the distal edge (24) of the base cap (22). This base (30) has a first securing means (32) attached to the base (30). The first securing means (32) will be discussed further below.

The base (30) constitutes the first electrical component of the lighting fixture (12). The next electrical component is a socket (40) connected to said base (30). The socket (40) is designed to receive any standard or modified light bulb. In one construction, said socket (40) is recessed within the distal edge (24) of the base cap (22). In an alternate embodiment, the socket (40) and base (30) extend beyond the distal edge (24) of the base cap (22). In the preferred embodiment, the socket (40) does not extend beyond the distal end (66) of the lamp shade (60) discussed below. The socket (40) is also connected to an electrical supply means (50) which runs from the socket (40), through the base (30), through the base cap (22), and through the stem (20) to the electrical source mentioned above.

The lamp shade (60) of the present embodiment is generally conical in shape and has a proximal end (62) having a narrow opening (64) and a distal end (66) having a wide opening. (68). The proximal end (62) of said lamp shade (60) has a second securing means (34) complimentary to said first securing means (32) on said base (30). The proximal end (62) of said lamp shade (60) is secured to the base (30) by said first securing means (32) and said second securing means (34).

An o-ring gasket (36) is placed around the base (30) and rests between the base cap (22) and the proximal end (62) of the lamp shade (60). When the first securing means (32) and the second securing means (34) are engaged, the o-ring gasket (36) forms a water tight seal the at the connection between the proximal end (62) of the lamp shade (60) and the base cap (22). The electrical components, including the socket (40), base (30), and electrical supply means (50) pass through the narrow opening (64) in the proximal end (62) of the lamp shade (60) and are surrounded by, recessed within and sheltered by the lamp shade (60). The base cap (22) covers the connection between the proximal end (62) of the lamp shade (60) and the base (30) performing the function of sealing the connection against precipitation and other forms of moisture.

In this preferred embodiment, the distal end (66) of the lamp shade (60) is pointed in a direction toward the ground such that the distal end (66) forms an angle with the horizon that is approximately thirty degrees. This allows the wide opening (68) of the lamp shade (60) to be pointed away from any falling precipitation or moisture and prevents the access of such precipitation or moisture to the electrical components.

Figure 3A:
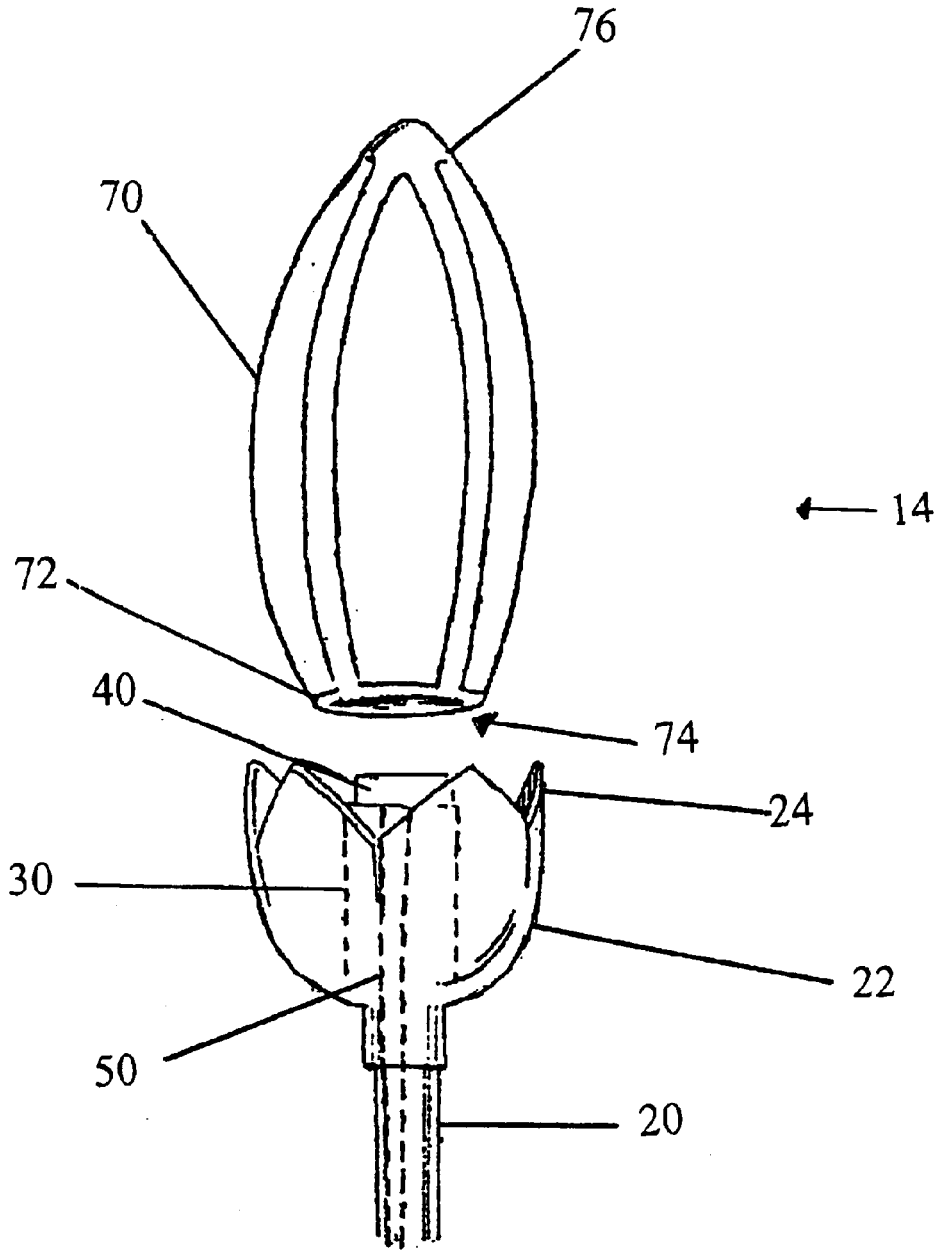
FIG. 3*a* shows a side view of the second preferred embodiment
Figure 3B:
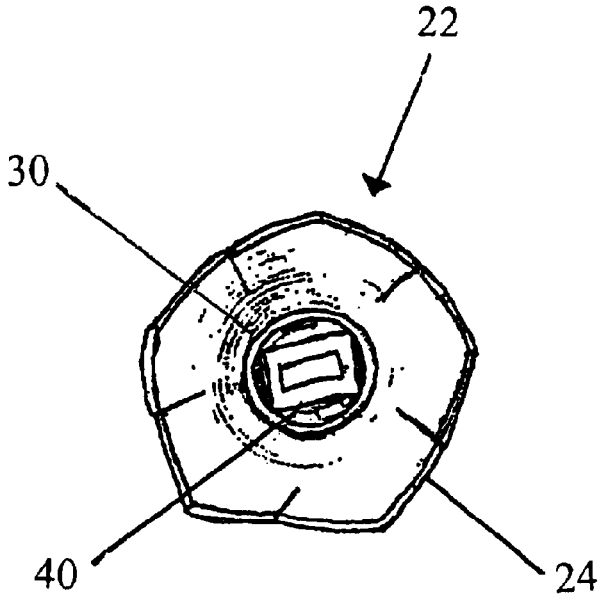
FIG. 3*b* shows a top view of the base cap of the second preferred embodiment
Figure 3C:
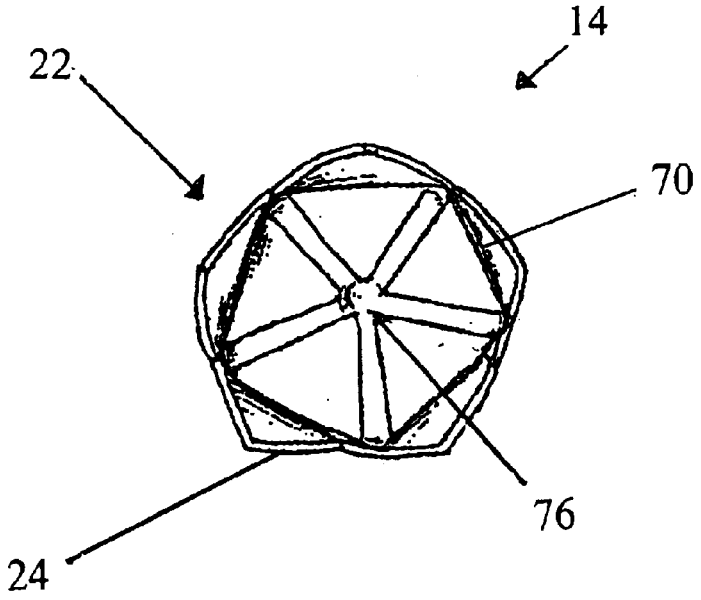
FIG. 3*c* shows a top view of the lighting fixture of the second preferred embodiment

As shown in FIGS. 3*a*, 3*b*, and 3*c*, the second preferred embodiment of the lighting fixture (14) of the present invention has the appearance of a closed flower bud where the petals of the bud form the lamp shade (70). The lighting fixture (14) comprises a stem (20) which consists of a hollow metal tube. One end of the stem (20) is connected to an electrical source by way of an electrical supply means (50). The electrical supply means (50) will be discussed further below.

The other end of the stem (20) is connected to a base cap (22). The base cap (22) has a distal edge (24) which is distant from the stem (20). A base (30) is connected to the base cap (22) and contained within the distal edge (24) of the base cap (22). The base (30) constitutes the first electrical component of the lighting fixture (14).

The next electrical component is a socket (40) connected to said base (30). The socket (40) is designed to receive any standard or modified light bulb. The socket (40) is also connected to an electrical supply means (50) which runs from the socket (40), through the base (30), through the base cap (22), and through the stem (20) to the electrical source mentioned above. The socket (40) and base (30) in this preferred embodiment, are arranged in the lighting fixture (14) such that the top of both the socket (40) and the base (30) rise above the distal edge (24) of the base cap (22). The arrangement of the socket (40) and base (30) rising above the distal edge (24) of the base cap (22) allows for accumulated precipitation to run-over the edge of the base cap (22) before reaching the level of the base (30) or socket (40). Alternate constructions of this embodiment allow for the socket (40) and base (30) to be below the distal edge (24) of the base cap (22).

The lamp shade (70) of the present embodiment is generally cylindrical in shape and has a proximal end (72) having a narrow opening (74) and a distal end (76) which is sealed. The proximal end (72) of said lamp shade (70) rests in the base cap (22) and the narrow opening (74) in the proximal end (72) surrounds and shelters the socket (40) and base (30).

In this preferred embodiment, the lighting fixture (14) is oriented nearly vertically such that the distal end (76) of the lamp shade (70) points toward the sky. In this configuration, the closed distal end (76) prevents any precipitation from entering, from the top, the area covered by the lamp shade (70). For any precipitation that accumulates in the base cap

(22) around the around the lamp shade (70), because of the relative positioning of the socket (40) base (30) and the distal edge (24) of the base cap (22) in the preferred embodiment discussed above, such precipitation would drain from the base cap (22) over the distal edge (24) of the base cap (22) prior to reaching the level of the base (30) and the socket (40).

The third preferred embodiment, depicted in FIGS. 4*a*, 4*b* and 4*c*, is capable of substituting for the second preferred embodiment of the lighting fixture (14) as appears in FIG. 1. As shown in FIGS. 4*a*, 4*b*, and 4*c*, the third preferred embodiment of the lighting fixture (16) of the present invention has the appearance of a partially open flower bud where the petals of the bud form the lamp shade (80). The lighting fixture (16) comprises a stem (20) which consists of a hollow metal tube. One end of the stem (20) is connected to an electrical source by way of an electrical supply means (50). The electrical supply means (50) will be discussed further below.

The other end of the stem (20) is connected to a base cap (22). The base cap (22) has a distal edge (24) which is distant from the stem (20). A base (30) is connected to the base cap (22) and contained within the distal edge (24) of the base cap (22). The base (30) constitutes the first electrical component of the lighting fixture (16).

The next electrical component is a socket (40) connected to said base (30). The socket (40) is designed to receive any standard or modified light bulb. The socket (40) is also connect to an electrical supply means (50) which runs from the socket (40), through the base (30), through the base cap (22), and through the stem (20) to the electrical source mentioned above. The base cap (22) further includes at least one drain hole (26) in the bottom of the base cap (22). The drain hole (26) allows for accumulated precipitation to drain out of the base cap (22) prior to reaching the level of the base (30) or socket (40).

In this embodiment, the socket (40) and base (30) is arranged in the lighting fixture (16) such that the top of both the socket (40) and the base (30) are below the distal edge (24) of the base cap (22). In an alternate construction of this embodiment, the socket (40) and base (30) rise above the distal edge (24) of the base cap (22). Either structure will function to carry out the purpose of the instant invention because the drain hole (26) allows for accumulated precipitation to drain out of the bottom of the base cap (22) before reaching the level of the base (30) or socket (40).

The lamp shade (80) of the present embodiment is generally cylindrical in shape and has a proximal end (82) having a narrow opening (84) and a distal end (86) having a wide opening (88). The lamp shade further includes a tube (90) arranged inside the lamp shade (80). The tube (90) has a sealed distal end (92) and an open proximal end (94). The open proximal end (94) is adjacent to the narrow opening (84) in the proximal end (82) of the lamp shade (80). The sealed distal end (92) is adjacent to the wide opening (88) in the distal end (86) of the lamp shade (80). The proximal end (82) of said lamp shade (80) rests in the base cap (22) and the narrow opening (84) in the proximal end (82) of the lamp shade (80) and the open proximal end (94) in the tube (90) surround and shelters the socket (40) and base (30).

In this preferred embodiment, the lighting fixture (16) is oriented nearly vertical such that the distal end (86) of the lamp shade (80) points toward the sky. In this configuration, the sealed distal end (92) of the tube (90) prevents any precipitation from entering, from the top, the area covered by the tube (90). For any precipitation that accumulates in the base cap (22), because of the drain hole (26) in the bottom of the base cap (22), such precipitation would drain from the base cap (22) through the drain hole (26) prior to reaching the level of the base (30) or the socket (40).

As described above, the first securing means (32) on the base (30) and second securing means (34) on the proximal end (62) of the lamp shade (60) is now known or to be discovered form of mechanical securing device, including but not limited to male and female threaded parts, male and female positioning screws and holes, set screws, securing screws, bosses and key-ways or grooved channels, or any other similar devices.

As described above, the electrical supply means (50) consists of standard conductive electrical wire capable of conducting an electrical current from an electricity source to the socket (40). The electrical supply means (50) is capable of conducting standard, low or high voltage electricity. The preferred embodiments of this invention employ low voltage electricity. The use of low voltage electricity lessens the likelihood of short-circuiting in the event water does reach the electrical components.

Each of the above described embodiments is capable of being used in other lamp structures that depicted in FIG. 1. A skilled artisan would recognize that each embodiment could be used on its own or in combination with any of the other embodiments in various lamp structures.

The above-described preferred embodiments are intended to illustrate the principles of the invention, but not to limit its scope. Other embodiments and variations of these preferred embodiments will be apparent to those skilled in the art and may be made without departing from the spirit and scope of the invention as defined in the following claims.

I claim:

1. A lighting fixture comprising:

(a) a stem;

(b) a base cap connected to said steal said base cap having a distal edge said base cap including at least one drain hole;

(c) a base connected to said base cap;

(d) a socket connected to said base, said socket designed to receive an electrical light bulb;

(e) said socket connected to an electrical supply means through said base, base cap and stem;

(f) a lamp shade having, a proximal end arid a distal end;

(g) said lamp shade surrounding said base and socket;

(h) said lamp shade is generally cylindrical in shape having a proximal end with a narrow opening and a distal end with a wide opening;

(i) said proximal end of said lamp shade connected to said base; and (j) a tube having a sealed distal end and an open proximal end contained within said lamp shade, said open proximal end connected to the proximal end of said lamp shade.

2. A lighting fixture comprising:

(a) a stem;

(b) a base cap connected to said stem, said base cap having a distal edge, said base cap including at least one dram hole;

(c) a base connected to said base cap;

(d) a socket connected to said base, said socket designed to receive an electrical light bulb;

(e) said base and said socket extending beyond the distal edge of said base cap;

(f) said socket connected to an electrical supply means through said base, base cap and stem;

(g) a lamp shade being generally conical in shape having a proximal end and said narrow opening and a distal end which is sealed; and (h) said proximal end of said lamp shade rests in said base cap and said narrow opening of said prod end fits over said base socket.

3. The lighting fixture of claim 2 wherein the electrical supply means supplies low voltage electricity.

4. A lighting fixture comprising:

(a) a stem;

(b) a base cap connected to said stem, said base cap having a distal edge;

(c) said base cap including at least one drain hole;

(d) a base connected to said base cap;

(e) a socket connected to said base, said socket designed to receive an electrical light bulb;

(f) said socket connected to an electrical supply means through said base, base cap and stem;

(g) a lamp shade being generally cylindrical in shape having a proximal end with a narrow opening and a distal end with a wide opening;

(h) a tube having a sealed distal end and an open proximal end contained within said lamp shade, said open proximal end connected to the proximal end of said lamp shade; and (i) said proximal end of said lamp shade rests in said base cap, wherein said narrow opening of said proximal end of said lamp shade and said opening of said proximal end of said tubes fits over said base and socket.

5. The lighting fixture of claim 4 wherein the electrical supply means supplies low voltage electricity.

* * * * *

UNITED STATES PATENT AND TRADEMARK OFFICE

CERTIFICATE OF CORRECTION

PATENT NO. : 6,776,511 B1
APPLICATION NO. : 09/654977
DATED : August 17, 2004
INVENTOR(S) : Lance Lindsay It is certified that error appears in the above-identified patent and that said Letters Patent is hereby corrected as shown below:

Col. 6, Claim 1(b), line 37, “steal” should be changed to -- stem --.
Claim 1(f), line 46, “arid” should be changed to -- and --.
Claim 2(b), line 60, ”dram” should be changed to -- drain --.
Col. 7, Claim 2(h), line 6, “prod” should be changed to -- proximal --.

Signed and Sealed this

Thirtieth Day of November, 2010

David J. Kappos

David J. Kappos
*Director of the United States Patent and Trademark Office*